US012460394B2

(12) United States Patent
Young et al.

(10) Patent No.: US 12,460,394 B2
(45) Date of Patent: Nov. 4, 2025

(54) WING SHROUD

(71) Applicant: Caterpillar Inc., Peoria, IL (US)

(72) Inventors: Andrew W. Young, New Braunfels, TX (US); Ezhil Valavan Karunakaran, Ariyalur DT (IN); Eric T. Sinn, Tremont, IL (US); Douglas C. Serrurier, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 767 days.

(21) Appl. No.: 17/664,680

(22) Filed: May 24, 2022

(65) Prior Publication Data

US 2023/0407607 A1 Dec. 21, 2023

(51) Int. Cl.
*E02F 9/28* (2006.01)
*E02F 3/60* (2006.01)

(52) U.S. Cl.
CPC ..... *E02F 9/2883* (2013.01)

(58) Field of Classification Search
CPC ... E02F 3/48; E02F 3/60; E02F 9/2883; E02F 9/2858; E02F 9/2833
See application file for complete search history.

(56) References Cited

U.S. PATENT DOCUMENTS

| | | | | |
|---|---|---|---|---|
| 3,014,293 | A | 12/1961 | Boatman et al. | |
| 4,047,312 | A * | 9/1977 | Stepe | E02F 9/2816 172/701.2 |
| 9,091,042 | B2 | 7/2015 | Guimaraes et al. | |
| D791,844 | S * | 7/2017 | Kunz | D15/28 |
| 9,970,181 | B2 | 5/2018 | Kunz | |
| 9,995,022 | B2 | 6/2018 | Hooijmans | |
| 2014/0305011 | A1 | 10/2014 | Leslie et al. | |
| 2017/0284073 | A1 | 10/2017 | Kunz | |
| 2021/0131077 | A1 | 5/2021 | Kunz et al. | |
| 2021/0246935 | A1 | 8/2021 | Grewell et al. | |

FOREIGN PATENT DOCUMENTS

| | | |
|---|---|---|
| AU | 2013311372 | 3/2017 |
| EP | 2149639 | 2/2010 |
| JP | 3406829 | 5/2003 |
| KR | 20010000376 | 1/2001 |
| KR | 200459039 | 3/2012 |
| KR | 20130076317 | 7/2013 |
| SE | 446641 | 9/1986 |
| WO | 2013067585 | 5/2013 |

* cited by examiner

*Primary Examiner* — Joseph M Rocca
*Assistant Examiner* — Robert E Pezzuto

(57) ABSTRACT

A wing shroud has a body including a side portion having a side inner surface, a side abutment surface, a side outer surface, and a side rear surface, a floor portion having a floor upper surface, a floor lower surface, a floor front surface, a floor outer surface, and a floor rear surface, and an attachment recess defined by a plurality of inward surfaces on the side and floor portions. The body also has a leading edge extending between the side inner surface, the side outer surface, the floor front surface, the floor upper surface, and the floor outer surface, and including an upper end, a transition portion, a lower curved portion, and a lower end.

20 Claims, 4 Drawing Sheets

WING SHROUD

TECHNICAL FIELD

The present disclosure relates generally to a replaceable wear part, and more particularly, to a replaceable wing shroud for protection of leading and side edges of a working implement, such as a dipper bucket used on an electric rope shovel.

BACKGROUND

A ground engaging tool (GET), such as a bucket, is mounted to a machine and used to dig into and to move materials, such as sand, gravel, stone, soil, or debris. Over time, as the GET engages with the materials, accelerated wear may occur on the GET, and, as a result, the life of the GET is reduced. Replacement of the GET is costly due to the expense of a new GET, downtime during replacement, and the effort and expense associated with the replacement process. To prolong the life of the GET and reduce the expenses associated with replacement of the GET, wear members, protectors, adaptors, or shrouds, are attached to edges of the GET. These wear members are easier to replace than the entire GET, and, by virtue of replacement of the shrouds or protectors, the overall life of the GET and of the bucket may be prolonged.

Wing shrouds are those used on wings, or corners, of the GET. Wing shrouds may be subject to uneven wear, with relatively more wear at particular locations on the shroud, also referred to as daylight spots. For example, the wing shroud described in U.S. Pat. No. 9,995,022, may be subject to uneven wear. The '022 patent describes the sidewalls and abutments surfaces of the wing shroud, which provide for ease and efficiency of mounting and dismounting of the wing shroud from a GET. Such a wing shroud may, however, experience the uneven wear described above.

The wing shroud of the present disclosure may solve one or more of the problems set forth above and/or other problems in the art. The scope of the current disclosure, however, is defined by the attached claims, and not by the ability to solve any specific problem.

SUMMARY

In one aspect, a wing shroud has a body that comprises a side portion having a side inner surface, a side abutment surface, a side outer surface, and a side rear surface, a floor portion having a floor upper surface, a floor lower surface, a floor front surface, a floor outer surface, and a floor rear surface, an attachment recess defined by a plurality of inward surfaces on the side portion and the floor portion, and a leading edge that extends between the side inner surface, the side outer surface, the floor front surface, the floor upper surface, and the floor outer surface, the leading edge having an upper end centered relative to an axis between the side inner surface and the side outer surface, a transition portion extending from the upper end and away from the axis, and a lower curved portion extending from the transition portion to a lower end.

In another aspect, a wing shroud has a body that comprises a side portion having a side inner surface, a side abutment surface, a side outer surface, and a side rear surface, a floor portion having a floor upper surface, a floor lower surface, a floor front surface, a floor outer surface, and a floor rear surface, an attachment recess defined by a plurality of inward surfaces on the side portion and the floor portion, and a leading edge that extends between the side inner surface, the side outer surface, the floor front surface, the floor upper surface, and the floor outer surface, the leading edge having an upper end centered along an axis between the side inner surface and the side outer surface, an upper transition portion, extending from the upper end at an angle relative to the axis, a lower transition portion, extending from the upper transition portion and being parallel to the axis, and a lower curved portion extending from the lower transition portion to a lower end.

In still another aspect, a wing shroud has a body that comprises a side portion having a side inner surface, a side abutment surface, a side outer surface, and a side rear surface, a floor portion having a floor upper surface, a floor lower surface, a floor front surface, a floor outer surface, and a floor rear surface, an attachment recess defined by a plurality of inward surfaces on the side portion and the floor portion, and a leading edge that extends between the side inner surface, the side outer surface, the floor front surface, the floor upper surface, and the floor outer surface, the leading edge having an upper end centered along an axis between the side inner surface and the side outer surface, an upper transition portion, extending from the upper end and being parallel to the axis, a lower transition portion, extending from the upper transition portion and at an angle relative to the axis, and a lower curved portion extending from the lower transition portion to a lower end.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, unless stated otherwise, relative terms, such as, for example, "about," "substantially," and "approximately" are used to indicate a possible variation of 10% in the stated value. Further, in this disclosure, references to widths, depths, and lengths provided with respect to various portions and/or surfaces are consistent, i.e., all widths are defined along a Y-axis, all depths are defined along a Z-axis, and all lengths are defined along an X-axis.

Figure 1:
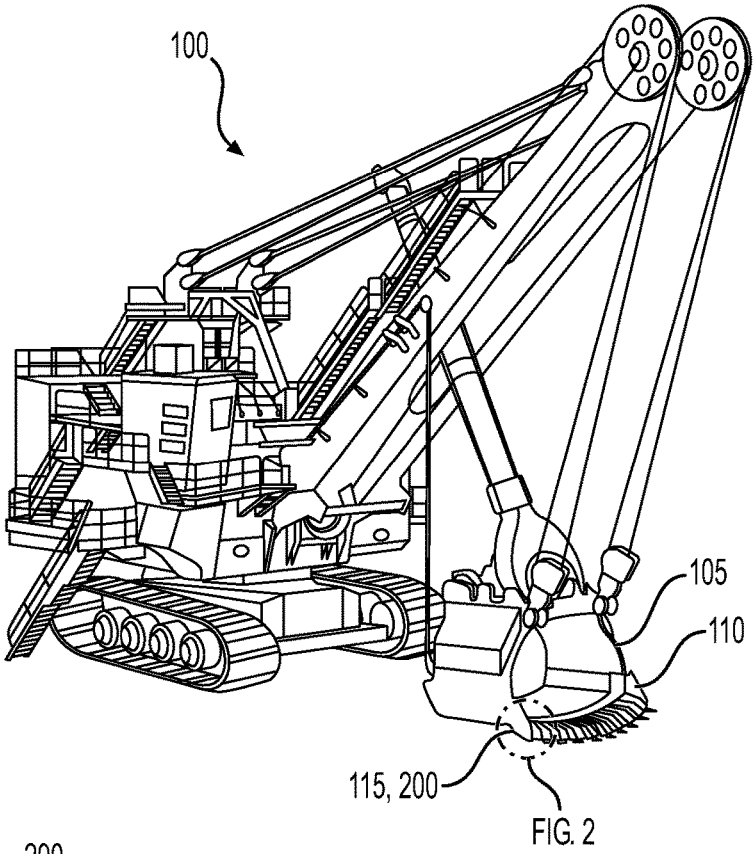
FIG. 1 is a schematic isometric view of an electric rope shovel, as an example of a machine having a ground engaging tool (GET) with shrouds, according to aspects of the disclosure.

FIG. 1 illustrates an electric rope shovel 100, as an example of a machine having a ground engaging tool (GET) 105 in the form of a bucket with shrouds 110. The shrouds 110 are attached to leading edges and corners 115 of the GET 105. Shrouds 110 may be formed of steel, for example, however the material that forms the shrouds 110 is not limited to steel, and other materials may be used.

Figure 2:
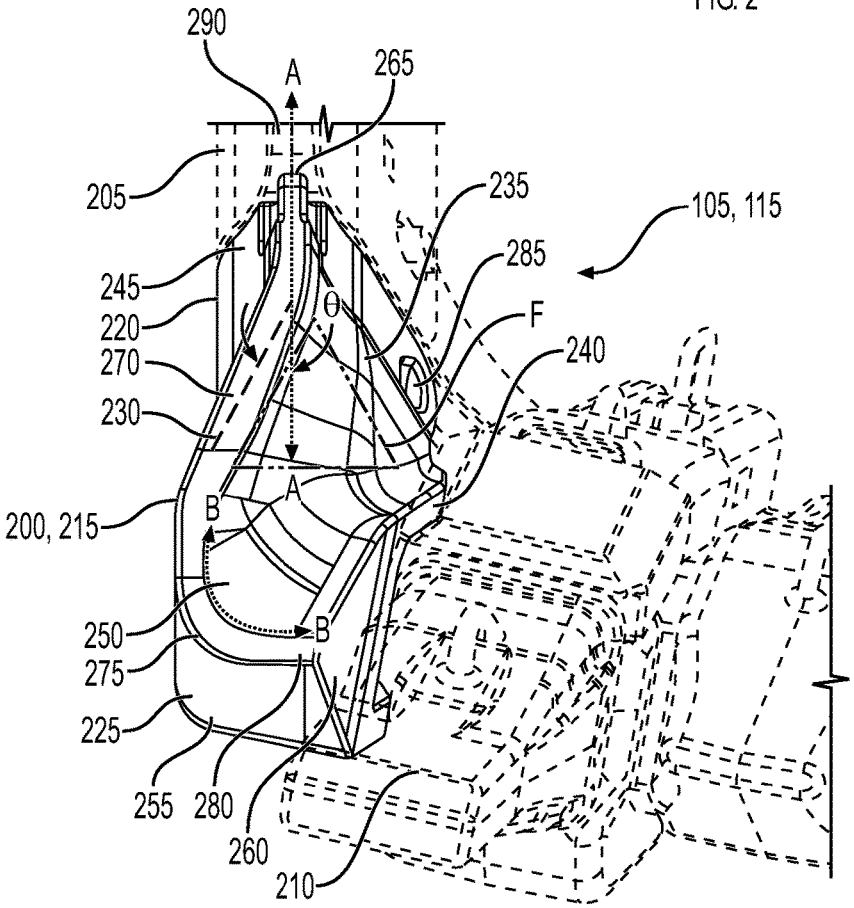
FIG. 2 is a schematic detail view of a corner of the GET, including a wing shroud, according to an embodiment of the disclosure.

FIGS. 2 to 6 are various views of a lower wing shroud 200 according to an embodiment of the disclosure. In particular, FIG. 2 is a detail view of the wing shroud 200 mounted to a corner 115 of the GET 105. The lower wing shroud 200 may be adjacent to an upper wing shroud 205, and another shroud or adapter 210, provided on a front edge of the GET 105. The lower wing shroud 200 has a body 215 that includes a side portion 220, a floor portion 225, and a leading edge 230. Each of the side portion 220 and the floor portion 225 includes a plurality of surfaces, shown in FIGS. 2 to 7, and described below. In particular, FIG. 2 shows a side inner surface 235, a side abutment surface 240, and a side outer surface 245 of the side portion 220, and a floor upper surface 250, a floor front surface 255, and a floor inner surface 260 of the floor portion 225. This figures also shows the leading edge 230 extending between the side inner surface 235, the side outer surface 245, the floor front surface 255, and the floor upper surface 250. The leading edge 230 has an upper end 265, adjacent to the upper wing shroud 205 in FIG. 2, a transition portion 270 extending from the upper end 265, a lower curved portion 275 extending from the transition portion, and a lower end 280 at the end of the lower curved portion 275. In addition, the body 215 may include at least one attachment opening, such as the attachment opening 285 provided on the side inner surface 235 of the side portion 220, shown in FIG. 2.

The upper end 265 of the leading edge 230 is aligned with an axis A-A, shown in FIG. 2, which may be a center line between the side inner surface 235 and the side outer surface 245. A leading edge 290 of the upper wing shroud 205 also aligns with the axis A-A, so that the lower wing shroud 200 can be used with existing upper wing shrouds 205. In addition, the transition portion 270 of the leading edge 230 of this embodiment extends away from, or at an angle θ relative to, axis A-A, as shown in FIG. 2. Further, the lower curved portion 275 extends from the transition portion 270 to the lower end 280 along a curve B-B, which is shown and described in more detail with respect to FIG. 3.

In addition, portions of the body 215 corresponding to the side inner surface 235 within a region F, shown in FIG. 2, may have a relatively greater thickness as compared to existing shrouds. For example, the body 215 may have an additional 10 mm of material within the region F, which can result in a relatively more even wear pattern on the surfaces of the lower wing shroud 200.

Figure 3:
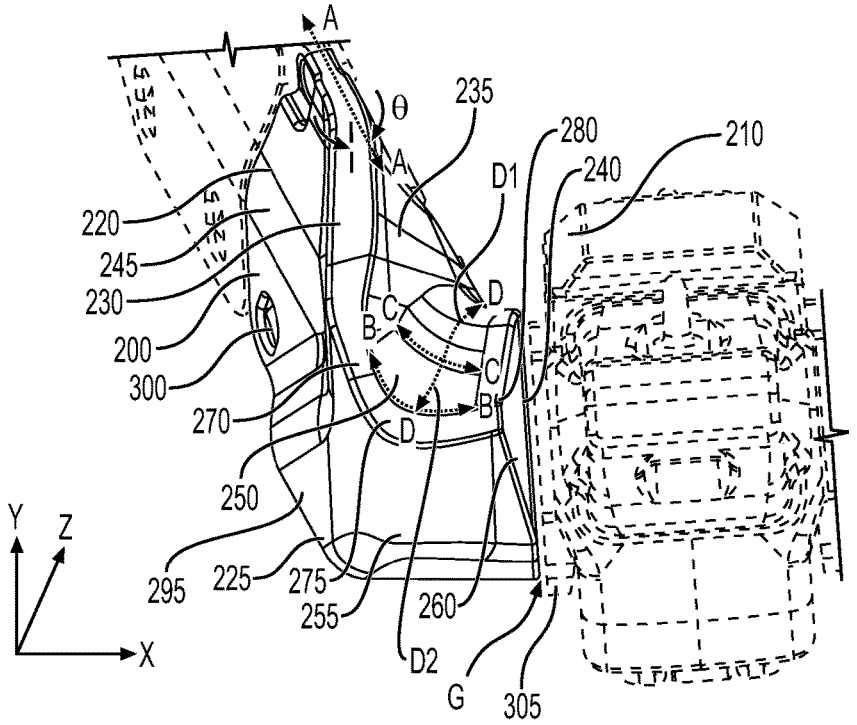
FIG. 3 is a schematic front view of a wing shroud shown in FIG. 2.

FIG. 3 is a front view of the lower wing shroud 200 shown in FIG. 2. As shown in FIG. 3, the floor portion 225 further includes a floor outer surface 295, in addition to the floor upper surface 250, the floor front surface 255, and the floor inner surface 260 described above, with respect to FIG. 2. FIG. 3 also shows the curve B-B of the lower curved portion 275 of the leading edge 230, the curve B-B being defined in the X-Y plane in FIG. 3 (that is, the curve B-B is defined by an x-axis and a y-axis), along a horizontal width and a vertical height of the shroud 200. The curve B-B may have a constant radius of curvature, or a varying radius of curvature, with a relatively smaller radius of curvature at a center of the curve B-B, and a gradually increasing radius of curvature towards ends of the curve B-B (that is, ends at which the lower curved portion 275 meets the transition portion 270 and the lower end 280). The radius of curvature of curve B-B may be maximized so as to encourage material to flow into the GET when the lower wing shroud 200 is in use with a GET. The lower curved portion 275 of the leading edge 230 also provides for sufficient protection of a lip of the GET 105 (not shown).

FIG. 3 also shows a curve C-C of the floor upper surface 250, defined in the X-Y plane in FIG. 3, or along a horizontal width and a vertical height of the shroud 200. As with the curve B-B, the curve C-C may have a constant radius of curvature, or a varying radius of curvature, with a relatively smaller radius of curvature at a center of the curve C-C, and a gradually increasing radius of curvature towards ends of the curve C-C, near the side abutment surface 240 and near the side inner surface 235, as shown in FIG. 3. In addition, FIG. 3 shows a curve D-D of the floor upper surface 250, defined in the Y-Z plane, or along a vertical height and a depth of the lower wing shroud 200. The curve D-D may have a varying radius of curvature, and may include a downward curve portion D1, towards a rear surface of the body 215 (the floor rear surface 320, shown in FIG. 5 and described below), and an upward curve portion D2, towards the leading edge 230. Further, FIG. 3 shows another attachment opening 300, provided in the side outer surface 245 of the side portion 220. In addition, FIG. 3 shows the lower wing shroud 200 alongside the adapter 210, with a shim 305 located therebetween, and a space or gap G, provided between the side abutment surface 240 and the shim 305. The gap may be, for example, about 2 mm. The shim 305 and the gap G are provided as part of an energy dampening system to prevent the adapter 210 from moving laterally and to prevent the shim 305 from falling off of the GET while the GET is in use. The side abutment surface 240 has a size and a shape configured so that the lower wing shroud 200 can be used with existing energy dampening systems. Still further, a depth of the floor inner surface 260 provides sufficient material to protect the lip of the GET 105.

Figure 4:
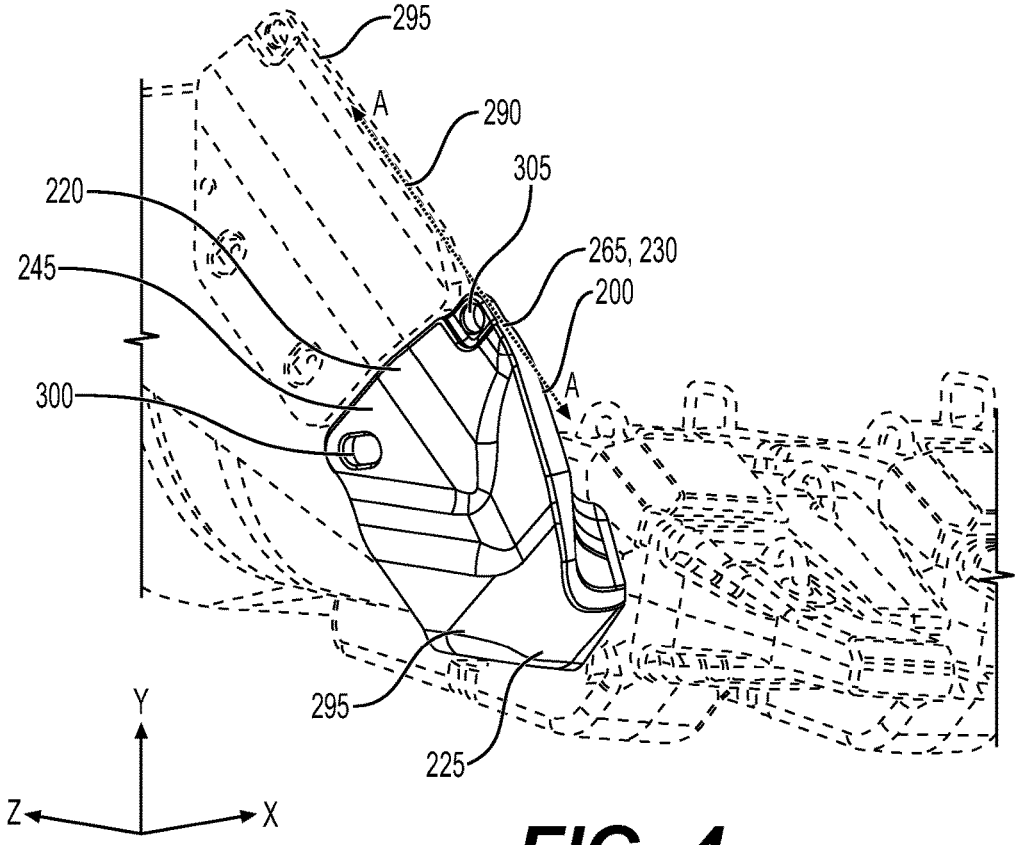
FIG. 4 is a schematic isometric view of the wing shroud shown in FIGS. 2 and 3.

FIG. 4 is an isometric view of the lower wing shroud 200 shown in FIGS. 2 and 3. In particular, FIG. 4 shows the side outer surface 245 of the side portion 220 and the floor outer surface 295 of the floor portion 225. FIG. 4 also shows the attachment opening 300, as well as an additional attachment opening 305. This figure also shows the alignment between the axis A-A and the upper end 265 of the leading edge 230 and the leading edge 290 of the upper wing shroud 205.

Figure 5:
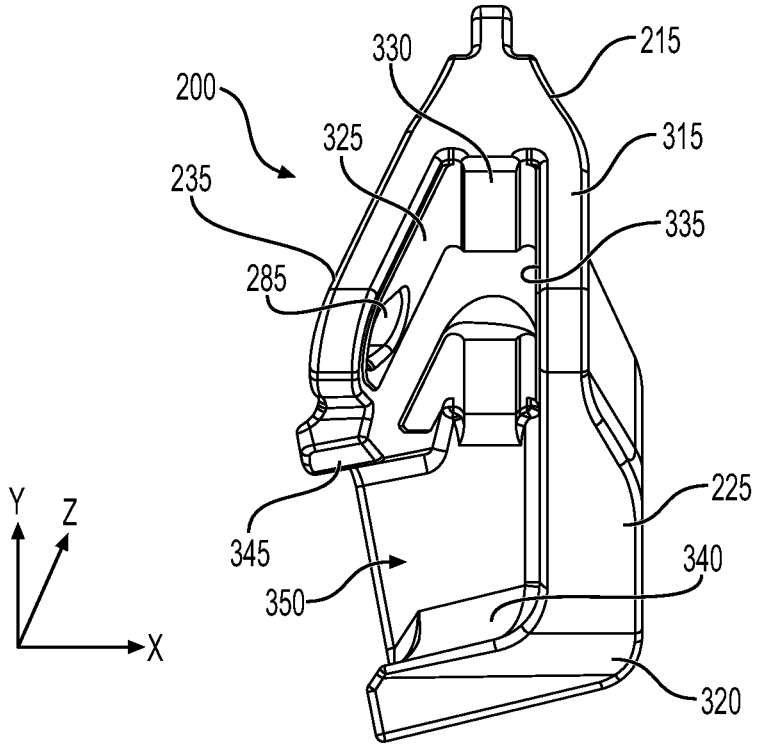
FIG. 5 is a schematic rear view of the wing shroud shown in FIGS. 2 to 4.

FIG. 5 is a schematic rear view of the lower wing shroud 200 shown in FIGS. 2 to 4. In particular, FIG. 5 shows a side rear surface 315, a floor rear surface 320, and a plurality of inward surfaces, including an inner inward surface 325, a rear inward surface 330, an outer inward surface 335, a lower inward surface 340, and an upper inward surface 345, provided in the side portion 220 and the floor portion 225 of the body 215. FIG. 5 also shows the attachment opening 285 as extending from the inner inward surface 325 to the side inner surface 235. These inward surfaces define an attachment recess 350, which may be used along with the attachment openings (including attachment opening 285, shown in FIG. 5) to attach the lower wing shroud 200 to the corner 115 of the GET 105. For example, the lower wing shroud 200 may be attached to the corner 115 using a retention system, such as the retention mechanism shown and described in U.S. Pat. No. 9,970,181 to Kunz. Other means of attaching the lower wing shroud 200 to the corner 115 of the GET 105 may be used. In addition, for example, the lower wing shroud 200 may be attached to the corner 115 using a hammered or a hammerless retention mechanism.

Figure 6:
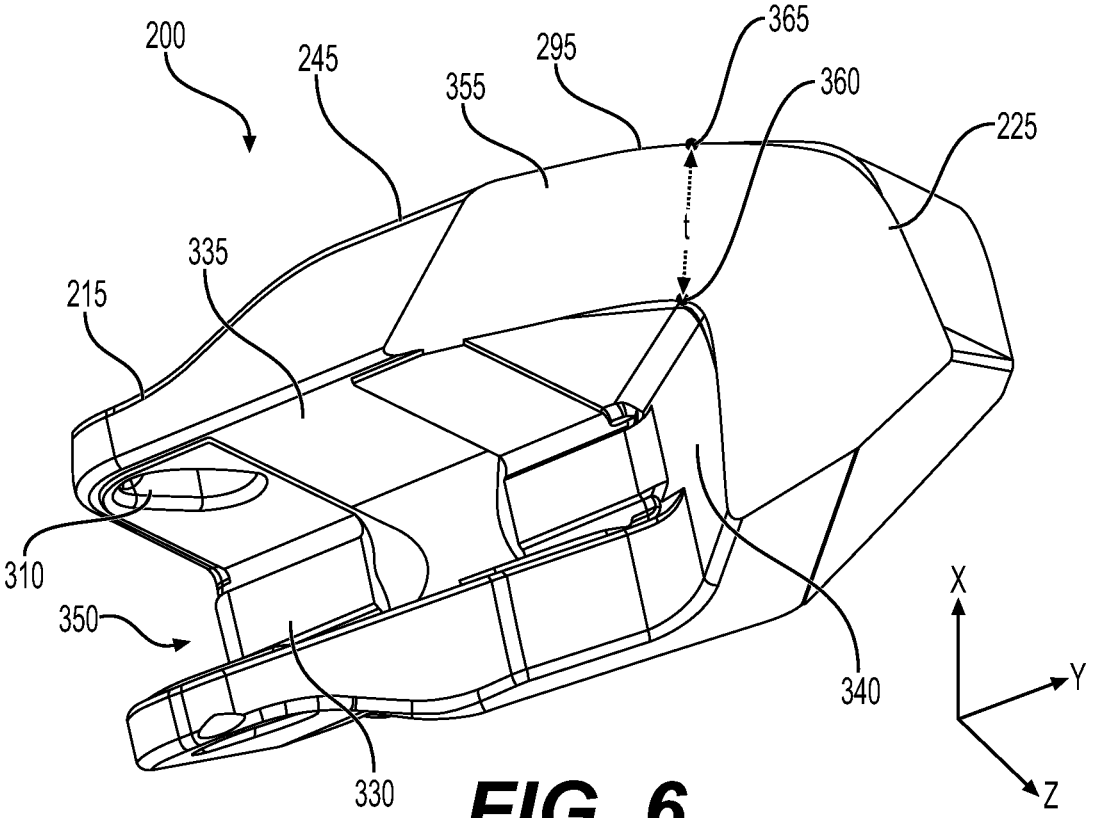
FIG. 6 is a schematic bottom view of the wing shroud shown in FIGS. 2 to 5

FIG. 6 is a view of lower surfaces of the lower wing shroud 200 shown in FIGS. 2 to 5. In particular, FIG. 6 shows a floor lower surface 355 of the floor portion 225 of the body 215. FIG. 6 also provides another view of the attachment recess 350, defined by the plurality of inward surfaces, including the rear inward surface 330, the outer inward surface 335, and the lower inward surface 340 of the side portion 215 and the floor portion 225 of the body 215, as well as the attachment opening 310, extending from the outer inward surface 335 toward the side outer surface 245. Further, FIG. 6 shows a thickness t of the body 215, measured as a length between one corner 360 of the attachment recess 350 and an edge 365 between the floor lower surface 355 and the floor outer surface 295. The thickness t is in a range of about 80 mm to about 120 mm, and, for example, may be about 98.4 mm.

Figure 7:
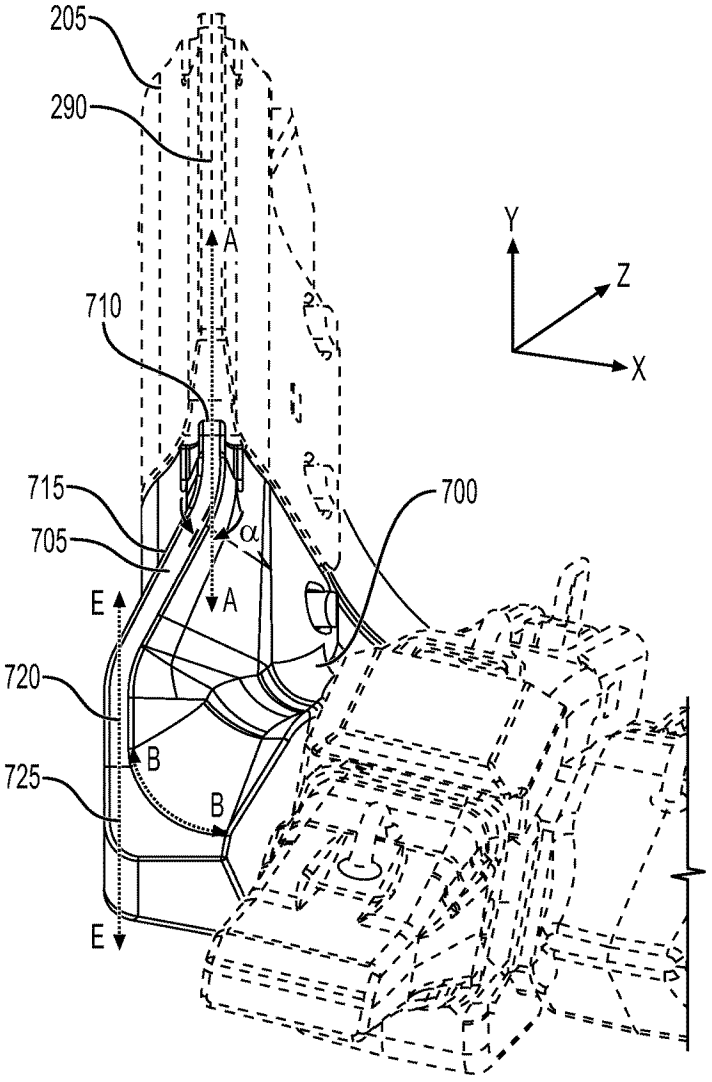
FIG. 7 is a schematic front view of a wing shroud according to an additional embodiment.

FIG. 7 is a schematic front view of a lower wing shroud 700 according to an additional embodiment. The lower wing shroud 700 includes many of the features of the lower wing shroud 200, discussed above and shown in FIGS. 2 to 6. The lower wing shroud 700 differs, however, from the lower wing shroud 200 in that it includes a leading edge 705 with an upper end 710, an upper transition portion 715, a lower transition portion 720, and a lower curved portion 725. The upper end 710 aligns with the axis A-A, along which the leading edge 290 of the upper wing shroud 205 aligns. The upper transition portion 715 extends at an angle $\alpha$ relative to the axis A-A. In addition, the lower transition portion 720 extends along an axis E-E that is parallel to the axis A-A, as shown in FIG. 7. Further, the lower curved portion 725 extends along the curve B-B, as with the lower curved portion 275 of the embodiment shown in FIGS. 2 to 6.

Figure 8:
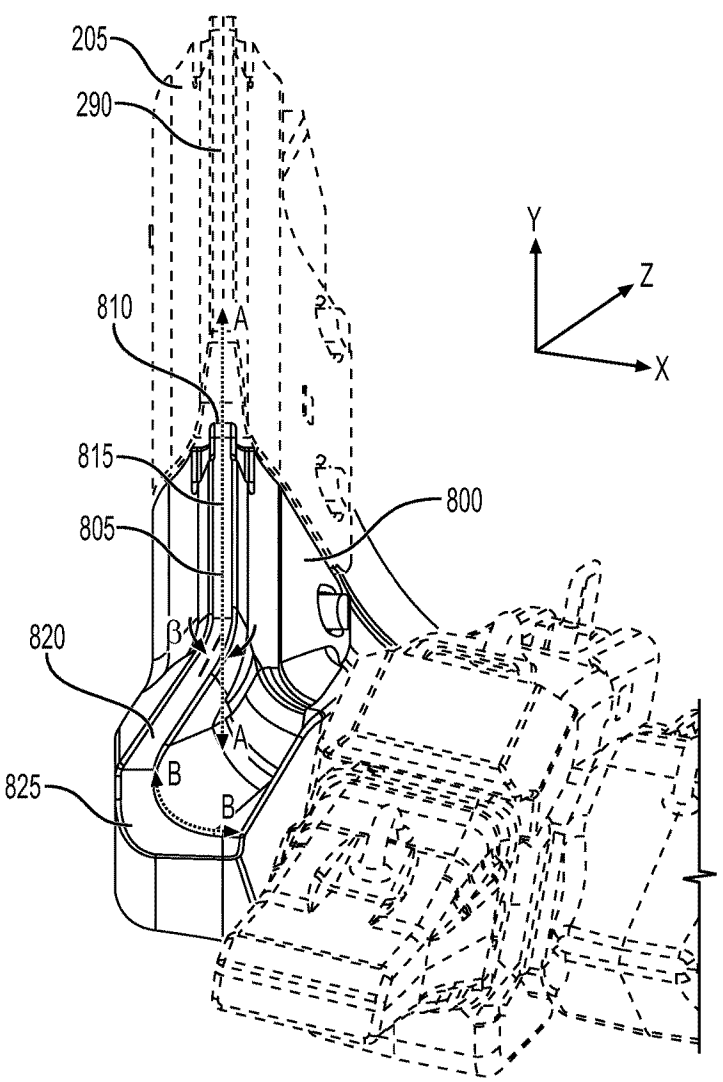
FIG. 8 is a schematic front view of a wing shroud according to yet another embodiment.

FIG. 8 is a schematic front view of a lower wing shroud 800 according to yet another embodiment. The lower wing shroud 800 includes many of the features of the lower wing shroud 200, discussed above and shown in FIGS. 2 to 6. The lower wing shroud 800 differs, however, from the lower wing shroud 200 in that it includes a leading edge 805 with an upper end 810, an upper transition portion 815, a lower transition portion 820, and a lower curved portion 825. The upper end 810 and the upper transition portion 815 align with the axis A-A, along which the leading edge 290 of the upper wing shroud 205 aligns. The lower transition portion 820 extends at an angle $\beta$ relative to the axis A-A, as shown in FIG. 8. In addition, the lower curved portion 825 extends along the curve B-B, as with the lower curved portion 275 of the embodiment shown in FIGS. 2 to 6, and the lower curved portion 725 of the embodiment shown in FIG. 7.

INDUSTRIAL APPLICABILITY

The disclosed aspects of the lower wing shrouds of the present disclosure may be used as replaceable wear parts having relatively longer wear life compared to known wing shrouds, and may be used to prolong the life of a GET 105. In particular, by virtue of the relationships between the various surfaces of the body 215 of the lower wing shroud 200 and the configuration of the leading edge 230 transitioning outward relative to the GET 105 and having more material compared to existing shrouds, a replaceable wear member is provided that can sustain wear in a more even distribution across its surfaces, thereby requiring less frequent replacement as compared to known shrouds. The lower wing shrouds of the present disclosure also encourages the flow of material into the GET 105 by virtue of their leading edges having lower curved portions and curved floor surfaces. The arrangement of the surfaces also provide protection for a lip of the GET 105. In addition, the lower wing shrouds of the present disclosure may be used with existing GETs and in combination with existing upper wing shrouds by virtue of the alignment of upper ends of the leading edges of the lower wing shrouds, and the shape of the plurality of inward surfaces that form the attachment recess. In addition, the lower wing shrouds of the present disclosure can be used with existing energy dampening systems by virtue of the shape and size of the side abutment surfaces.

The lower wing shrouds discussed herein may have a relatively increased weight as compared to existing shrouds. For example, the weight of the lower wing shrouds discussed herein may be about 35.8% greater than a weight of an existing lower wing shroud, with the added material on the lower wing shroud being placed only on portions of the lower wing shroud subject to relatively increased wear. In this way, a wear efficiency, which is determined by dividing a wear life by an initial weight of a shroud) can be optimized.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A wing shroud having a body that comprises:

a side portion having a side inner surface, a side abutment surface, a side outer surface, and a side rear surface;

a floor portion having a floor upper surface, a floor lower surface, a floor front surface, a floor outer surface, a floor rear surface, and a floor inner surface;

an attachment recess defined by a plurality of inward surfaces on the side portion and the floor portion; and a leading edge that extends between the side inner surface, the side outer surface, the floor inner surface, the floor front surface, the floor upper surface, and the floor outer surface, the leading edge having an upper end centered relative to an axis between the side inner surface and the side outer surface, a transition portion extending from the upper end and away from the axis, and a lower curved portion extending from the transition portion to a lower end that meets the floor inner surface.

2. The wing shroud of claim 1, wherein the lower curved portion of the leading edge is curved relative to a plane defined by a horizontal width and a vertical height of the shroud, the plane being parallel to the floor front surface.

3. The wing shroud of claim 2, wherein the floor upper surface is also curved relative to the plane defined by the horizontal width and the vertical height of the shroud.

4. The wing shroud of claim 3, wherein the floor upper surface is also curved relative to a plane defined by the vertical height and a depth of the shroud.

5. The wing shroud of claim 4, wherein the floor upper surface includes a downward curve and an upward curve relative to the plane defined by the vertical height and the depth of the shroud.

6. The wing shroud of claim 1, wherein the transition portion extends between the upper end and the lower curved portion at an angle relative to the axis.

7. The wing shroud of claim 1, wherein the body further comprises one or more attachment openings provided in the side portion.

8. The wing shroud of claim 7, wherein the one or more attachment openings extend from one of the plurality of inward surfaces to one of the side outer surface and the side inner surface.

9. A wing shroud having a body that comprises:

a side portion having a side inner surface, a side abutment surface, a side outer surface, and a side rear surface;

a floor portion having a floor upper surface, a floor lower surface, a floor front surface, a floor outer surface, a floor rear surface, and a floor inner surface;

an attachment recess defined by a plurality of inward surfaces on the side portion and the floor portion; and a leading edge that extends between the side inner surface, the side outer surface, the floor inner surface, the floor front surface, the floor upper surface, and the floor outer surface, the leading edge having an upper end centered along an axis between the side inner surface and the side outer surface, an upper transition portion, extending from the upper end at an angle relative to the axis, a lower transition portion, extending from the upper transition portion and being parallel to the axis, and a lower curved portion extending from the lower transition portion to a lower end that meets the floor inner surface.

10. The wing shroud of claim 9, wherein the lower curved portion of the leading edge is curved relative to a plane defined by a horizontal width and a vertical height of the shroud, the plane being parallel to the floor front surface.

11. The wing shroud of claim 10, wherein the floor upper surface is also curved relative to the plane defined by the horizontal width and the vertical height of the shroud.

12. The wing shroud of claim 11, wherein the floor upper surface is also curved relative to a plane defined by the vertical height and a depth of the shroud.

13. The wing shroud of claim 12, wherein the floor upper surface includes a downward curve and an upward curve relative to the plane defined by the vertical height and the depth of the shroud.

14. The wing shroud of claim 9, wherein the body further comprises one or more attachment openings provided in the side portion.

15. The wing shroud of claim 14, wherein the one or more attachment openings extend from one of the plurality of inward surfaces to one of the side outer surface and the side inner surface.

16. A wing shroud having a body that comprises:

a side portion having a side inner surface, a side abutment surface, a side outer surface, and a side rear surface;

a floor portion having a floor upper surface, a floor lower surface, a floor front surface, a floor outer surface, a floor rear surface, and a floor inner surface;

an attachment recess defined by a plurality of inward surfaces on the side portion and the floor portion; and a leading edge that extends between the side inner surface, the side outer surface, the floor inner surface, the floor front surface, the floor upper surface, and the floor outer surface, the leading edge having an upper end centered along an axis between the side inner surface and the side outer surface, an upper transition portion, extending from the upper end and being parallel to the axis, a lower transition portion, extending from the upper transition portion and at an angle relative to the axis, and a lower curved portion extending from the lower transition portion to a lower end that meets the floor inner surface.

17. The wing shroud of claim 16, wherein the lower curved portion of the leading edge is curved relative to a plane defined by a horizontal width and a vertical height of the shroud, the plane being parallel to the floor front surface.

18. The wing shroud of claim 17, wherein the floor upper surface is also curved relative to the plane defined by the horizontal width and the vertical height of the shroud.

19. The wing shroud of claim 18, wherein the floor upper surface is also curved relative to a plane defined by the vertical height and a depth of the shroud.

20. The wing shroud of claim 16, wherein the body further comprises one or more attachment openings provided in the side portion.

* * * * *